United States Patent [19]

Ou

[11] Patent Number: 4,519,845

[45] Date of Patent: May 28, 1985

[54] SEPARATION OF SUCROSE FROM MOLASSES

[75] Inventor: Di-Yi Ou, La Grange, Ill.

[73] Assignee: UOP Inc., Des Plaines, Ill.

[21] Appl. No.: 578,464

[22] Filed: Feb. 9, 1984

[51] Int. Cl.[3] ..... C13D 3/12

[52] U.S. Cl. ..... 127/46.2; 127/55; 210/502.1; 210/635; 502/402

[58] Field of Search ..... 127/46.2, 46.3, 55; 502/402; 210/502.1, 635

[56] References Cited

U.S. PATENT DOCUMENTS

| | | | |
|---|---|---|---|
| 2,985,589 | 5/1961 | Broughton et al. | 210/676 |
| 3,706,812 | 12/1972 | Derosset et al. | 210/791 |
| 4,333,770 | 6/1982 | Neuzil et al. | 127/46.3 |
| 4,402,832 | 9/1983 | Gerhold | 127/46.2 |
| 4,405,378 | 9/1983 | Kulprathipanja | 127/55 |

OTHER PUBLICATIONS

"Chromatographic Separation of Sugar Solutions–The Finnsugar Molasses Desugarization Process", by H. J. Hongisto–Technical Department, Finnish Sugar Company Ltd., Kantvik, Finland–Paper presented to the 23rd Tech. Conf. British Sugar Corp. Ltd., 1976–*International Sugar Journal,* 79, (941), XVIII–1977, pp. 131–134.

"Molasses Sugar Recovery by Liquid Distribution Chromatograph", by Dr. Mohammad Munir (Central Laboratory, Suddeutsche Zucker AG., 6719 Obrigheim 5, Wormser Str. 1, Germany)–Paper presented to the 15th General Assembly C.I.T.S., 1975–*International Sugar Journal,* 78, 1976, pp. 100–106.

*Primary Examiner*—Richard V. Fisher
*Assistant Examiner*—W. Gary Jones
*Attorney, Agent, or Firm*—William H. Page, II; Louis A. Morris

[57] ABSTRACT

A process for the separation of sucrose from molasses and the unique adsorbent used to accomplish the separation. The adsorbent comprises a mixture of an ion retardation resin and a calcium and potassium cation exchanged nuclearly sulfonated styrene cation exchange resin having about 8% crosslinkage. In the process, the molasses feedstock is passed through a bed of the adsorbent and the sugar components, including sucrose, are eluted first and the mineral salts and betaine selectively retained. The retained components may be desorbed with water.

12 Claims, 4 Drawing Figures

SEPARATION OF SUCROSE FROM MOLASSES

BACKGROUND OF THE INVENTION

Field of the Invention

The field of art to which this invention pertains is solid bed adsorptive separation. More specifically, the invention relates to a process for separating sucrose from molasses.

BACKGROUND INFORMATION

Sucrose, which is a common form of sugar, is widely used in the food industry. The usual source for this compound is found in the juice of sugar cane, sugar beets and other sucrose-containing materials. After the readily recoverable sucrose has been extracted from these sources, the mother liquors which are generally termed "molasses" will still contain a relatively large amount of sucrose along with other sugars such as glucose, fructose, raffinose, etc. The latter compounds along with salts, amino acids, betaine, pyrollidone, carboxylic acid, etc. constitute crystallization inhibitors which make the recovery of the remaining sucrose difficult to accomplish and thus make the further recovery of the sucrose economically impractical. In addition, the impurities which are present impart a taste to the molasses which renders the same inedible for human consumption.

Sugar beet molasses may contain approximately 50% sucrose and, therefore, it is highly desirable to extract this sucrose from the aforesaid molasses. At the present time, there are only a few methods for extracting the sucrose present in molasses from the compounds of the type hereinbefore set forth. One such process which is utilized is the Steffan process in which the beet molasses is diluted to about 20% solids, refrigerated, and treated with a calcium compound such as calcium oxide. This results in the reaction of the sucrose present with the calcium oxide to form tricalcium sucrate which is an insoluble granular precipitate. This precipitate can then be removed from the diluted molasses solution by filtration followed by washing, to remove adhering impurities. The tricalcium sucrate is returned to the beet processing operation by adding to the incoming hot beet juice. Under such conditions the tricalcium sucrate decomposes, releasing the sucrose to solution so that the calcium oxide has acted as a purification agent. However, a disadvantage which is inherent in the process is that certain impurities are recycled, particularly raffinose, which is a trisaccharide material. With the continual recycling of the tricalcium sucrate, the amount of raffinose present begins to accumulate and will retard the desired crystallization of the sucrose, thus making it necessary to discard a certain amount of circulating molasses from time to time.

In addition to the Steffan process, it is also possible to separate sucrose by utilizing non-continuous chromatographic procedures which employ ion exchange resins to isolate sucrose from the molasses. However, neither of the procedures results in a complete separation of the sucrose even though high purity can be obtained. The processes which effect this separation employ a strong acid, polystyrene ion exchange resin in the alkaline or alkaline earth form and typically are as described by H. J. Hongisto (Technical Department, Finnish Sugar Company Ltd., Kantvik, Finland), "Chromatographic Separation of Sugar Solutions; The Finsugar Molasses Desugarization Process" paper presented to the 23rd Tech. Conf., British Sugar Comp. Ltd., 1976; and by Dr. Mohammad Munir (Central Laboratory, Suddeutsche Zucker AG., 6719 Obrigheim 5, Wormser Str. 1, Germany), "Molasses Sugar Recovery by Liquid Distribution Chromatography"; the *International Sugar Journal,* 1976, 78, 100–106. Unfortunately, these processes generate a three-fraction separation in which nitrogenous compounds (betaine) are most selectively retained, then sugars to a lesser extent and finally mineral salts.

Other processes for molasses purification include an ion retardation process in which ion retardation resin is employed. Ion retardation resins comprise a mixture of cation and anion adsorption sites with the mixing taking place at the molecular level. These resins are prepared by polymerizing an anionic monomer inside the pores of an anionic exchange resin or a cationic monomer inside a cationic exchange resin. Ion retardation resins are known to retain mineral salts from a molasses feedstock while allowing the sugars and betaine to elute together.

The present invention is based on the discovery of a unique mixture of an ion retardation resin and ion exchange resin that elutes sucrose with the relative retention of betaine and mineral salts.

SUMMARY OF THE INVENTION

In brief summary, the invention is, in one embodiment, a process for the separation of sucrose from molasses feedstocks through a bed of adsorbent comprising a mixture of an ion retardation resin and a calcium and potassium ion exchanged nuclearly sulfonated styrene cation exchange resin having about 8% crosslinkage, the adsorbent having a higher relative selectivity for the mineral salts and betaine components of the feedstocks than for sucrose, adsorbing the mineral salts and betaine components in the adsorbent bed and removing a product stream comprising sucrose from the adsorbent bed.

In a second embodiment, the invention is the adsorbent itself, as used in the process of the first embodiment.

Other objects and embodiments of the invention encompass details about feed mixtures, adsorbent, process schemes, desorbent materials and operating conditions, all of which are hereinafter disclosed in the following discussions of each of the facets of the present invention.

DESCRIPTION OF THE INVENTION

Figure 1:
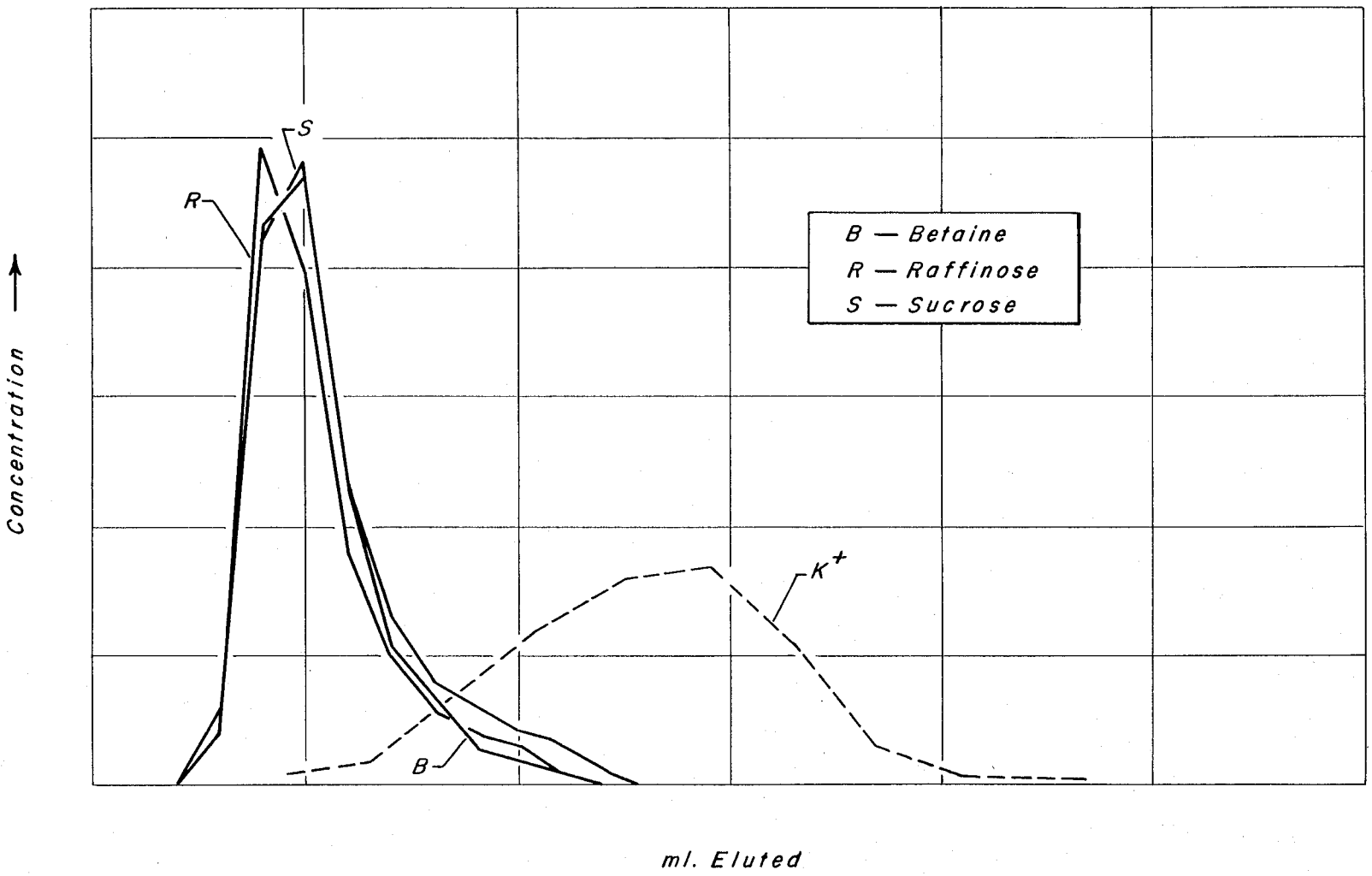
FIGS. 1, 2, 3 and 4 are graphs of data generated Examples I, II, III and IV respectively.

This invention relates to a process for separating sucrose from molasses. More specifically, the invention is concerned with a process for separating and recovering sucrose from molasses and still permitting the molasses to be utilized in other fields such as for fertilizers or animal feed. The presence of other components in the molasses which act as crystallization inhibitors make the recovery of sucrose relatively difficult to accomplish in a process based on crystallization.

In this process the presence of another sugar, such as raffinose (comprising about 1 wt. % of a molasses having a sucrose content of 51 wt. %), presents no problem since the other sugar will be separated with the sucrose and the product stream will comprise the sugar mixture. If desired, the raffinose may be removed from the feed or product streams by methods known to the art, such as enziomatic conversion which cleaves the trisaccharide raffinose structure to the more desirable mono- and disaccharides. The process of the present invention comprises passing the feed mixture over an adsorbent of the type hereinafter set forth in greater detail. The passage of the feed stream over the adsorbent will result in the adsorption of the mineral salts and betaine while permitting the sugars in the feed stream to pass through the adsorption zone. Thereafter the salts and betaine may be desorbed from the adsorbent by treating the adsorbent with a desorbent material, specifically water. Preferred adsorption and desorption conditions include a temperature in the range of from about 50° C. to about 80° C. and a pressure sufficient to ensure a liquid phase.

For purposes of this invention, the various terms which are hereinafter used may be defined in the following manner.

A "feed mixture" is a mixture containing one or more extract components and one or more raffinate components to be separated by the process. The term "feed stream" indicates a stream of a feed mixture which passes to the adsorbent used in the process.

An "extract component" is a compound or type of compound that is more selectively adsorbed by the adsorbent while a "raffinate component" is a compound or type of compound that is less selectively adsorbed. The term "desorbent material" shall mean generally a material capable of desorbing an extract component. The term "desorbent stream" or "desorbent input stream" indicates the stream through which desorbent material passes to the adsorbent. The term "raffinate stream" or "raffinate output stream" means a stream through which a raffinate component is removed from the adsorbent. The composition of the raffinate stream can vary from essentially 100% desorbent material to essentially 100% raffinate components. The term "extract stream" or "extract output stream" shall mean a stream through which an extract material which has been desorbed by a desorbent material is removed from the adsorbent. The composition of the extract stream, likewise, can vary from essentially 100% desorbent material to essentially 100% extract components. At least a portion of the extract stream and preferably at least a portion of the raffinate stream from the separation process are passed to separation means, typically fractionators, where at least a portion of desorbent material is separated to produce an extract product and a raffinate product. The terms "extract product" and "raffinate product" mean products produced by the process containing, respectively, an extract component and a raffinate component in higher concentrations than those found in the extract stream and the raffinate stream.

The feed mixtures which are charged to the process of the present invention will comprise sugar sources, a specific source which is utilized in the present invention comprising molasses. Molasses is the mother liquor remaining from the juice of sugar cane or beet, i.e., "thick juice", after removal by crystallization of most of the sucrose therefrom. As hereinbefore discussed, molasses such as cane molasses or sugar beet molasses will contain about 50% sucrose as well as other sugars such as glucose, fructose, raffinose as well as mineral salts and alkaloids, betaine, said other sugars and compounds being present in varying amounts in the sugar source. Betaine is a colorless, inert, crystalline, alkaloidal substance having the formula $C_5H_{11}NO_2H_2O$. The most prevalent mineral salt in molasses is potassium chloride. The adsorbent of the present invention is capable of selectively adsorbing the betaine and the mineral salts in molasses while allowing the sugars to pass through the system unchanged.

Relative selectivity can be expressed not only for one feed compound as compared to another but can also be expressed between any feed mixture component and the desorbent material. The selectivity, (B), as used throughout this specification is defined as the ratio of the two components of the adsorbed phase over the ratio of the same two components in the unadsorbed phase at equilibrium conditions. Relative selectivity is shown as Equation 1, below.

$$\text{Selectivity} = (B) = \frac{[\text{ wt. percent } C/\text{wt. percent } D]_A}{[\text{wt. percent } C/\text{wt. percent } D]_U} \qquad \text{Equation 1}$$

where C and D are two components of the feed represented in weight percent and the subscripts A and U represent the adsorbed and unadsorbed phases respectively. The equilibrium conditions are determined when the feed passing over a bed of adsorbent does not change composition after contacting the bed of adsorbent. In other words, there is no net transfer of material occurring between the unadsorbed and adsorbed phases. Where selectivity of two components approaches 1.0, there is no preferential adsorption of one component by the adsorbent with respect to the other; they are both adsorbed (or non-adsorbed) to about the same degree with respect to each other. As the (B) becomes less than or greater than 1.0, there is a preferential adsorption by the adsorbent for one component with respect to the other. When comparing the selectivity by the adsorbent of one component C over component D, a (B) larger than 1.0 indicates preferential adsorption of component C within the adsorbent. A (B) less than 1.0 would indicate that component D is preferentially adsorbed leaving an unadsorbed phase richer in component C and an adsorbed phase richer in component D. Ideally, desorbent materials should have a selectivity equal to about 1 or slightly less than 1 with respect to all extract components so that all of the extract components can be desorbed as a class with reasonable flow rates of desorbent material, and so that extract components can displace desorbent material in a subsequent adsorption step. While separation of an extract component from a raffinate component is theoretically possible when the selectivity of the adsorbent for the extract component with respect to the raffinate component is greater than 1, it is preferred that such selectivity approach a value of 2. Like relative volatility, the higher the selectivity, the easier the separation is to perform. Higher selectivities permit a smaller amount of adsorbent to be used. The third important characteristic is the rate of exchange of the extract component of the feed mixture material or, in other words, the relative rate of desorption of the extract component. This characteristic relates directly to the amount of desorbent material that must be employed in the process to recover the extract component from the adsorbent; faster rates of exchange reduce the amount of desorbent material needed to remove the extract component and therefore permit a reduction in the operating cost of the process. With faster rates of exchange, less desorbent material has to be pumped through the process and separated from the extract stream for reuse in the process.

I have discovered an adsorbent capable of effecting the rejective separation of the sugars in molasses from the mineral salts and betaine. By "rejective separation" it is meant that the product stream containing the sugars is the raffinate stream, while the mineral salts and betaine are selectively adsorbed by the adsorbent. The raffinose and sucrose are not separated, but that is not considered a problem since the raffinose content does not significantly detract from the commercial value of sucrose.

The unique adsorbent of the present invention comprises a mixture of an ion retardation resin and a calcium and potassium cation exchanged nuclearly sulfonated styrene cation exchange resin having about 8% crosslinkage. The ion retardation resin may comprise an anionic monomer polymerized inside the pores of an anionic exchange resin or a cationic monomer polymerized inside the pores of a cationic exchange resin. An example of an acceptable ion retardation resin is Dow 11A8 obtained from Dow Chemical Company.

The preferred volume ratio of cation exchange resins to ion retardation resins is from about 40:60 to about 70:30.

The cation exchange resin for use in the adsorbent mixture of the present invention may be any of the commercially available resins which are about 8% crosslinked, such as Dowex 50X8 obtained from Dow Chemical Company. This resin as obtained, however, is in the hydrogen form and, therefore, to obtain the cation exchange resin as required by the present invention, it must be exchanged with potassium and calcium ions. That may be accomplished by contacting the resin with fresh feedstock continuously for a period of tire, since the molasses, of course, contains potassium ions and almost always a sufficient arount of calcium ions. The completion of ion exchange is monitored by measuring the pH value of effluent which at the end of the ion exchange approaches the pH of feedstock.

The ion retardation resin is preferably equilibrated through successive contact of feedstock and water in a multiplicity of cycles so as to reach a state of equilibrium as to the mineral salts content which enables desorption of amounts of mineral salts in excess of the amounts required to reach equilibrium. Equilibrations of both the retardation and exchange resins is best effected prior to them being mixed together.

As mentioned above, the known molasses separation processes using a cation exchange resin achieve a three-fraction separation in which the sugars are the intermediately retained component. It is also known that the ion retardation resins will retain mineral salts, but elute betaine and sugars together. I have furthermore discovered that the potassium and calcium exchanged 8% crosslinked cation exchange resin will retain betaine and elute sugars and mineral salts together. My discovery which comprises the present invention is that when the two different resins are mixed, the betaine and mineral salts will be selectively retained together and the sugars eluted.

Desorbent materials used in various prior art adsorptive separation processes vary depending upon such factors as the type of operation employed. In adsorptive separation processes which are generally operated continuously at substantially constant pressures and temperatures to ensure liquid phase, the desorbent material must be judiciously selected to satisfy many criteria. First, the desorbent material should displace an extract component from the adsorbent with reasonable mass flow rates without itself being so strongly adsorbed as to unduly prevent an extract component from displacing the desorbent material in a following adsorption cycle. Expressed in terms of the selectivity (hereinafter discussed in more detail), it is preferred that the adsorbent be more selective for all of the extract components with respect to a raffinate component than it is for the desorbent material with respect to a raffinate component. Secondly, desorbent materials must be compatible with the particular adsorbent and the particular feed mixture. More specifically, they must not reduce or destroy the critical selectivity of the adsorbent for an extract component with respect to a raffinate component. Additionally, desorbent materials should not chemically react with or cause a chemical reaction of either an extract component or a raffinate component. Both the extract stream and the raffinate stream are typically removed from the adsorbent in admixture with desorbent material and any chemical reaction involving a desorbent material and an extract component or a raffinate product or both. Since both the raffinate stream and the extract stream typically contain desorbent materials, desorbent materials should additionally be substances which are easily separable from the feed mixture that is passed into the process. Without a method of separating at least a portion of the desorbent material present in the extract stream and the raffinate stream, the concentration of an extract component in the extract product and the concentration of a raffinate component in the raffinate product would not be very high, nor would the desorbent material be available for reuse in the process. It is contemplated that at least a portion of the desorbent material will be separated from the extract and the raffinate streams by distillation or evaporation, but other separation methods such as reverse osmosis may also be employed alone or in conbination with distillation or evaporation. When the products are foodstuffs intended for human consumption, desorbent materials should also be non-toxic. Finally, desorbent materials should also be materials which are readily available and therefore reasonable in cost.

The desorbent material found to be most effective in desorbing the mineral salts and betaine from the adsorbent of the present invention is water. Water is particularly advantageous for use in a bed of resins where the feedstock is also largely water, as in molasses, because shrinkage of the bed will be minimized. Such shrinkage is likely to occur in situations where dissimilar liquids such as water and an alcohol are alternately contacted with the resin bed.

The adsorbent may be employed in the form of a dense compact fixed bed which is alternatively contacted with the feed mixture and desorbent. In the simplest embodiment of the invention, the adsorbent is employed in the form of a single static bed in which case the process is only semi-continuous. In another embodiment, a set of two or more static beds may be employed in fixed bed contacting with appropriate valving so that the feed mixture is passed through one or more adsorbent beds, while the desorbent can be passed through one or more of the other beds in the set. The flow of feed mixture and desorbent may be either up or down through the adsorbent bed. Any of the conventional apparatus employed in static bed fluid-solid contacting may be used.

Moving bed or simulated moving bed flow systems, however, have a much greater separation efficiency than fixed bed systems and are therefore preferred. In the moving bed or simulated moving bed processes, the adsorption and desorption operations are continuously taking place which allows both continuous production of an extract and a raffinate stream and the continual use of feed and desorbent streams. One preferred embodiment of this process utilizes what is known in the art as the simulated moving bed countercurrent flow system. The operating principles and sequence of such a flow system are described in U.S. Pat. No. 2, 985,589, incorporated herein by reference. In such a system, it is the progressive movement of multiple liquid access points down an adsorbent chamber that simulates the upward movement of adsorbent contained in the chamber. Reference can also be made to D. B. Broughton U.S. Pat. No. 2,985,589 and to a paper entitled, "Continuous Adsorptive Processing—A New Separation Technique" by D. B. Broughton presented at the 34th Annual Meeting of the Society of Chemical Engineers at Tokyo, Japan on Apr. 2, 1969, both references incorporated herein by reference, for further explanation of the simulated moving bed countercurrent process flow scheme.

Another embodiment of a simulated moving bed flow system suitable for use in the process of the present invention is the co-current high efficiency simulated moving bed process disclosed in U.S. Pat. No. 4,402,832, incorporated by reference herein.

It is contemplated that at least a portion of the raffinate output stream will pass into a separation means wherein at least a portion of the desorbent can be separated to produce a raffinate product containing a reduced concentration of desorbent. Preferably, but not necessary to the operation of the process, at least a portion of the extract output stream will also be passed to a separation means wherein at least a portion of the desorbent can be separated to produce a desorbent stream which can be reused in the process and an extract product containing a reduced concentration of displacement fluid. The separation means will typically be a fractionation column, the design and operation of which is well known to the separation art.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor-phase operation. Adsorption conditions will include a temperature range of from about 50° C. to about 80° C. and a pressure sufficient to maintain liquid-phase. Desorption conditions will include the same range of temperatures and pressures as used for adsorption conditions.

The size of the units which can utilize the process of this invention can vary anywhere from those of pilot-plant scale (see for example U.S. Pat. No. 3,706,812) to those of commercial scale and can range in flow rates from as little as a few cc an hour up to many thousands of gallons per hour.

A dynamic testing apparatus is employed to test various adsorbents with a particular feed mixture and desorbent to measure the adsorbent characteristics of adsorption capacity and exchange rate. The apparatus consists of a straight adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect quantitatively or determine qualitatively one or more components in the effluent stream leaving the adsorbent chamber. A pulse test, performed using this apparatus and the following general procedure, is used to determine data for various adsorbent systems. The adsorbent is filled to equilibrium with a particular desorbent by passing the desorbent through the adsorbent chamber. Following a 70 cc water prepulse, a 10 ml pulse of feed containing known concentrations of a particular extract component or of a raffinate component or both, all diluted in desorbent, is injected for a duration of several minutes. Desorbent flow is resumed, and the extract component or the raffinate component (or both) are eluted as in a liquid-solid chromatographic operation. The effluent can be analyzed on-stream or alternatively, effluent samples can be collected periodically and later analyzed separately by analytical equipment and traces of the envelopes or corresponding component peaks developed.

From information derived from the test, adsorbent performance can be rated in terms of void volume, retention volume for an extract or a raffinate component, and the rate of desorption of an extract component from the adsorbent. The retention volume of an extract or a raffinate component may be characterized by the distance between the center of the peak envelope of the extract or raffinate component, respectively, and the peak envelopes of a tracer component or some other known reference point. It is expressed in terms of the volume in cubic centimeters of desorbent pumped during this time interval represented by the distance between the peak envelopes. The rate of exchange of an extract component with the desorbent can generally be characterized by the width of the peak envelopes at half intensity. The narrower the peak width, the faster the desorption rate. The desorption rate can also be characterized by the distance between the center of a tracer peak envelope and the disappearance of an extract component which has just been desorbed. This distance is again the volume of desorbent pumped during this time interval.

The following non-limiting examples are presented to illustrate the process of the present invention and are not intended to unduly restrict the scope of the claims attached hereto.

EXAMPLE I

The above described pulse test apparatus was used to obtain data for this example. The liquid temperature was 65° C. and the flow was up the column at the rate of 1.0 ml/min. The feed stream comprised 10 wt. % sucrose, 10 wt. % raffinose, 10 wt. % betaine, 1 wt. % KCl and 69 wt. % water. The column was packed with the aforementioned Dow retardation resin 11A8 that had been equilibrated by rinsing the resin bed with 30 bed volumes of 10 wt. % KCl solution followed by 50 bed volumes of distilled water. The desorbent fluid used was water.

The results of this example are shown on the accompanying FIG. 1. It is apparent from FIG. 1 that a very good separation of KCl from the other components was obtained.

EXAMPLE II

Figure 2:
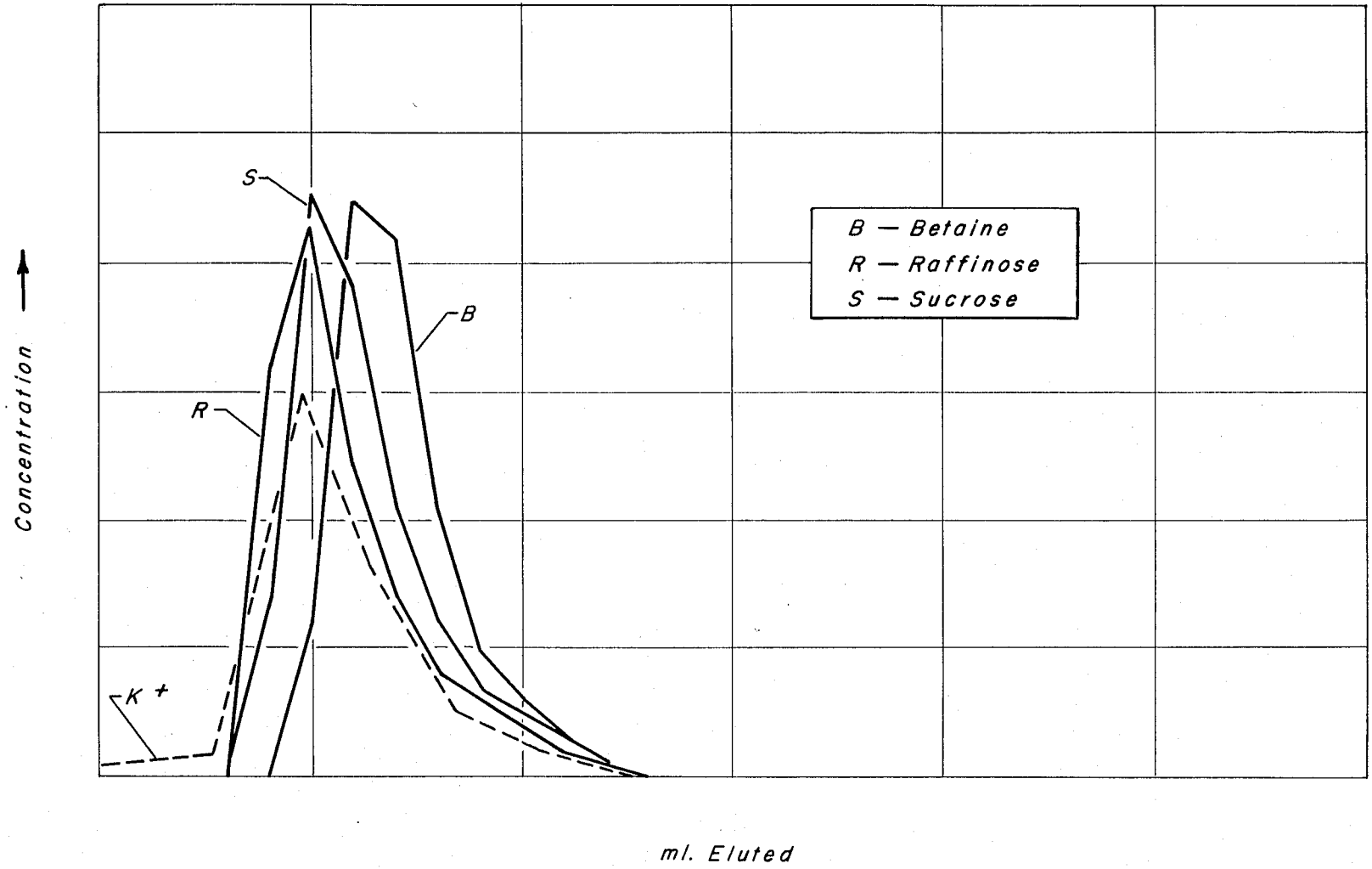

A pulse test like that of Example I was conducted except that the aforementioned Dowex 50X8 cation exchange resin equilibrated with potassium ions was used as the adsorbent. The results, as shown in FIG. 2, were that substantially no separation of any component was obtained.

EXAMPLE III

Figure 3:
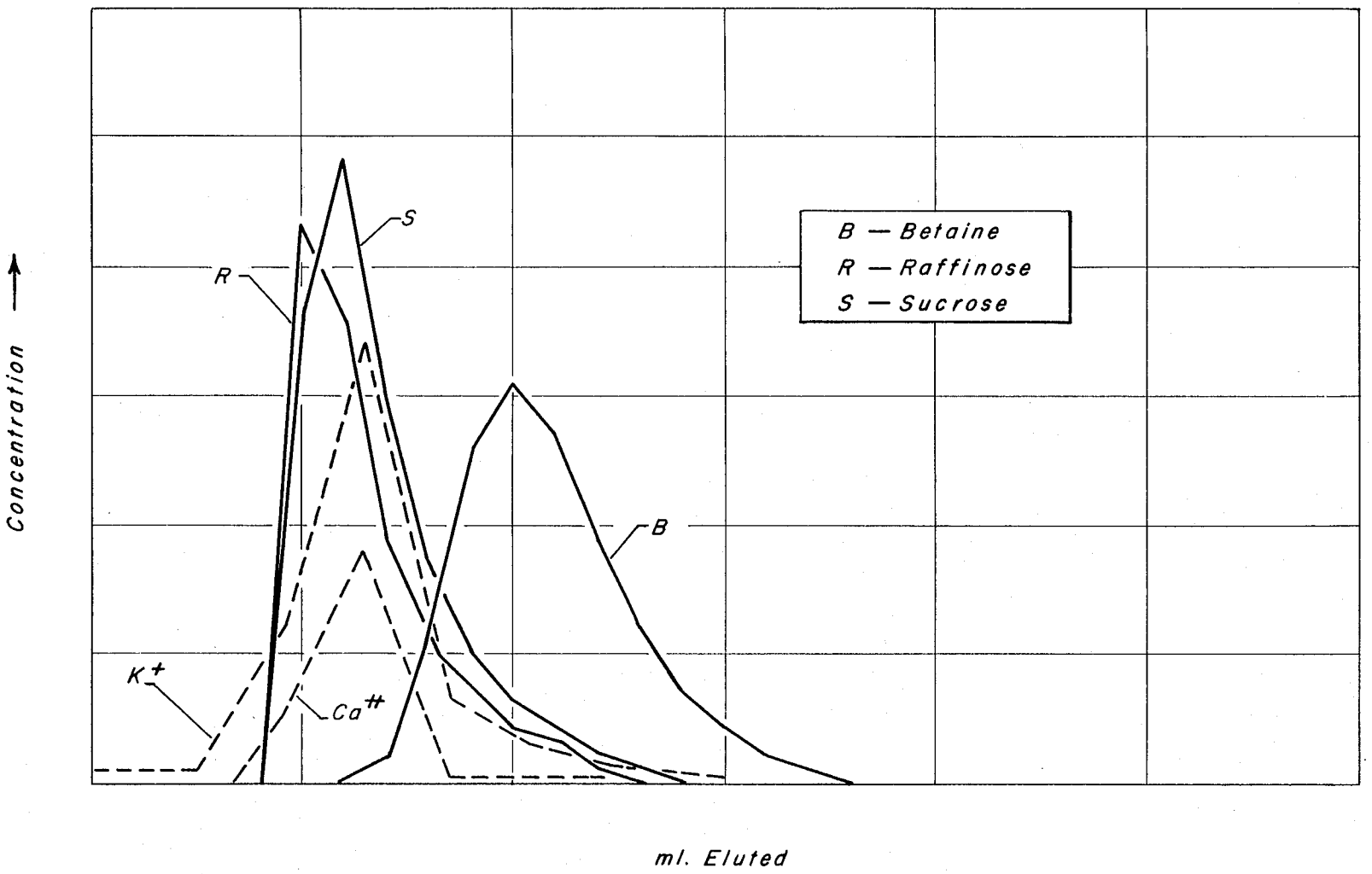

The test of Example II was repeated except that the feed stream was changed to an aqueous solution of 10 wt. % each of sucrose and raffinose, 10 wt. % betaine, 1.5 wt. % $K+$ (2.86 wt. % KCl), 0.15 wt. % $Ca++$ (0.42 wt. % $CaCl_2$) and 66.72 wt. % water. The Dow 50X8 resin was equilibrated with this feed prior to the test. The results are shown in FIG. 3. In this case the betaine was selectively retained by the adsorbent but, unfortunately, the sugars and mineral salts ($Ca++$ and $K+$) eluted together.

EXAMPLE IV

Finally, a series of three tests were run using adsorbents of the present invention comprising mixtures of equilibrated Dowex 50X8 and Dow 11A8 in the volume ratios of 40:60, 50:50 and 60:40 for the first, second and third tests, respectively. The conditions and other details of the tests were identical to the test of Example III.

Figure 4:
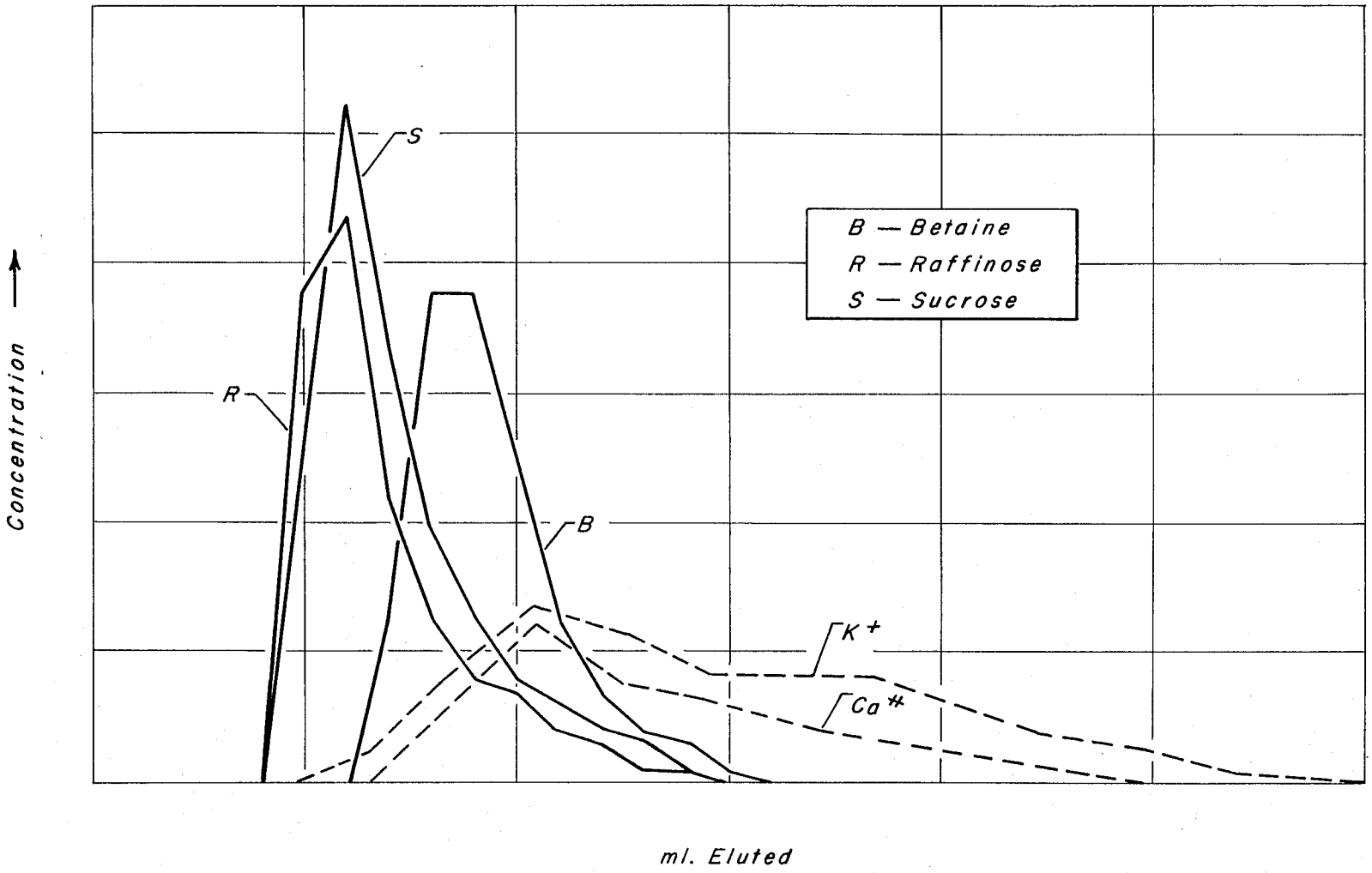

All three tests demonstrated a separation of sugars from the other components with the sugars eluted first and together. The results of the best of the three separations are shown in FIG. 4. That figure clearly shows sucrose and raffinose eluting first with the degree of separation from the remaining components achieved entirely adequate for commercial exploitation as in the aforementioned simulated moving bed processes.

I claim as my invention:

1. A process for the separation of sucrose from molasses feedstock through a bed of adsorbent comprising a mixture of an ion retardation resin and a calcium and potassium ion exchanged nuclearly sulfonated styrene cation exchanged resin having about 8% crosslinkage, said adsorbent having a higher relative selectivity for mineral salts and betaine components of said feedstock than for sucrose, adsorbing said mineral salts and betaine components in said adsorbent bed and removing a product stream comprising sucrose from said adsorbent bed.

2. The process of claim 1 wherein said ion retardation resin comprises an anionic monomer polymerized inside the pores of an anion exchange resin.

3. The process of claim 1 wherein prior to being mixed to obtain said bed of adsorbent said cation exchange resin is equilibrated by continuous contacting with feedstock for a period of time and said ion retardation resin is equilibrated by successive contacting with feedstock and water in a multiplicity of cycles.

4. The process of claim 1 wherein said mineral salts and betaine are removed from said bed of adsorbent by passing water through said bed to effect the desorption of said mineral salts and betaine therefrom.

5. The process of claim 4 wherein the conditions at which said separation and desorption are effected comprises a temperature of from about 50° C. to about 80° C. and a pressure sufficient to maintain liquid phase.

6. The process of claim 1 wherein the volume ratio of said cation exchange resin to said ion retardation resin is from about 40:60 to about 70:30.

7. The process of claim 1 wherein said process is effected with a simulated moving bed flow system.

8. The process of claim 7 wherein said simulated moving bed flow system is of the countercurrent type.

9. The process of claim 7 wherein said simulated moving bed flow system is of the co-current high efficiency type.

10. An adsorbent useful for the separation of sucrose from molasses comprising a mixture of an ion retardation resin and a calcium and potassium ion exchanged nuclearly sulfonated styrene cation exchange resin having about 8% crosslinkage.

11. The adsorbent of claim 10 wherein said ion retardation resin comprises an anionic monomer polymerized inside the pores of an anion exchange resin.

12. The adsorbent of claim 11 wherein the volume ratio of said cation exchange resin to said ion retardation resin is from about 40:60 to about 70:30.

* * * * *